US005599219A

United States Patent [19]

Green

[11] Patent Number: 5,599,219

[45] Date of Patent: Feb. 4, 1997

[54] INFLATABLE BLADDER WITH INTERNAL BRACE FOR CONFORMING THE BLADDER TO THE BODY OF A WEARER

[75] Inventor: Charles T. Green, San Diego, Calif.

[73] Assignee: Soniform, Inc., El Cajon, Calif.

[21] Appl. No.: 398,883

[22] Filed: Mar. 6, 1995

[51] Int. Cl.[6] ..... B63C 9/08

[52] U.S. Cl. ..... 441/106; 441/116

[58] Field of Search ..... 405/186; 441/88, 441/92–118; 114/345; 5/455, 458

[56] References Cited

U.S. PATENT DOCUMENTS

| | | | |
|---|---|---|---|
| 2,905,954 | 9/1959 | Lanciano | 441/116 |
| 4,561,853 | 12/1985 | Faulconer et al. | 441/106 |
| 4,823,417 | 4/1989 | Fukuichi . | |
| 4,990,115 | 2/1991 | Vorhauer . | |
| 5,011,334 | 4/1991 | Vorhauer . | |
| 5,046,894 | 9/1991 | Bergstrom . | |
| 5,385,496 | 1/1995 | Seligman | 441/88 |

FOREIGN PATENT DOCUMENTS

| | | | |
|---|---|---|---|
| 279969 | 7/1934 | Italy | 441/106 |

*Primary Examiner*—Stephen Avila

[57] ABSTRACT

An inflatable bladder for a buoyancy compensator or the like is provided with an internal brace which causes the inflated bladder to conform to the body of the wearer. The bladder includes a liner and a shell which are secured together to form an internal chamber. The brace is generally triangularly shaped and includes a pair of connecting panels which diverge from the liner to the shell and which are connected to the liner and the shell.

7 Claims, 4 Drawing Sheets

INFLATABLE BLADDER WITH INTERNAL BRACE FOR CONFORMING THE BLADDER TO THE BODY OF A WEARER

BACKGROUND

This invention relates to inflatable bladders, and, more particularly, to an inflatable bladder which includes an internal brace which causes the inflated bladder to conform to the body of a wearer.

The invention finds particular utility in buoyancy compensators. A buoyancy compensator is worn by an underwater diver for adjusting the buoyancy of the diver depending upon the diver's depth below the water level. Examples of buoyancy compensators are described in U.S. Pat. Nos. 4,990,115, 5,011,334, and 5,046,894.

A buoyancy compensator or B.C. generally includes a bladder which provides an inflatable chamber. The chamber is inflated with air or other gases to provide buoyancy.

Buoyancy compensators include single bag and double bag devices. A double bag B.C. uses a nylon fabric shell that is sewn separately and assembled with a free standing polyurethane bladder inserted inside of the nylon shell. The bladder serves as the air holding component of the system, and the shell serves to control the form of the inflated bladder.

A single bag B.C. is constructed from a composite material that incorporates a polyurethane film laminated or bonded to the back of a nylon fabric. This composite simultaneously forms the shell and the bladder similar to a double bag but a single layer material and a single construction technique. Essentially, the bladder becomes the outer shell.

As a result of its inherent construction, single bag B.C.'s often rely on internal braces or stays that restrict and control the expansion of the bladder as it is inflated with air. The normal techniques used for these braces are either a 3 dimensional stay, which is a separate "tube" of composite material that is welded or bonded to the walls of the bladder, or a 2 dimensional stay, which bonds the front wall of the bladder directly to the back wall. Both of these techniques produce a straight or rectilinear bladder form. To a certain degree, a 2 dimensional stay will constrict the bladder in each joint area and allows the sides of the bladder to bend when an external force is applied. However, a two dimensional stay still relies on the external system to create conformity and produces only hard angles instead of a curved surface.

SUMMARY OF THE INVENTION

The bladder provides an inflatable bladder which conforms to the body of a wearer. The bladder is formed from a liner and a shell which are secured together to form an internal chamber. An internal brace within the chamber is secured to the liner and the shell for conforming the bladder when the bladder is inflated. The brace is generally triangular and includes one or more pairs of connecting panels which diverge outwardly from the liner to the shell and which are connected to the liner and the shell. The brace effectively shortens the liner by allowing the liner to expand more than the shell, thereby causing the bladder to assume a curved shape.

DESCRIPTION OF THE DRAWING

The invention will be explained in conjunction with an illustrative embodiment shown in the accompanying drawing, in which.

DESCRIPTION OF THE EMBODIMENTS

Figure 1:
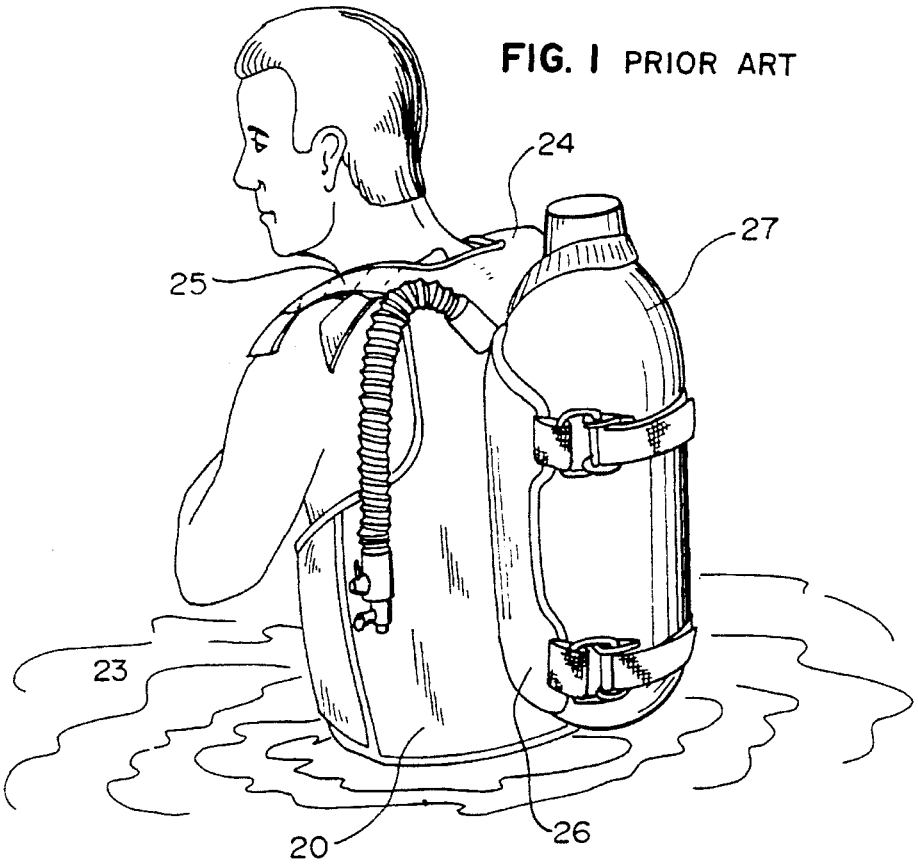
FIG. 1 PRIOR ART
FIG. 1 illustrates a prior art buoyancy compensator which is equipped with an inflatable bladder.

FIG. 1 illustrates a prior art buoyancy compensator 20. The B.C. 20 includes a back portion 21, right and left side lobes 23, and right and left shoulder portions 24 and 25. The side lobes and shoulder portions are connected by a conventional waist and shoulder harness assembly. The B.C. is conventionally used in conjunction with a backpack 26 which supports a tank 27 of pressurized breathing air.

Figure 2:
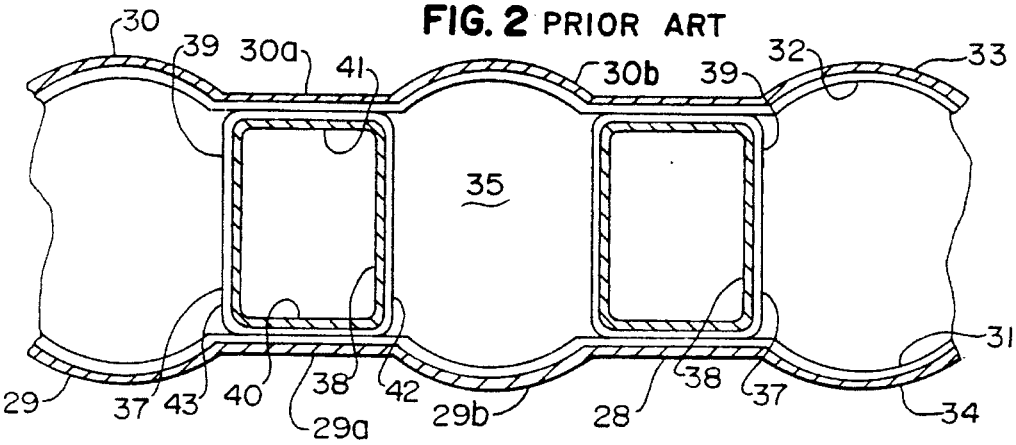
FIG. 2 PRIOR ART
FIG. 2 is a fragmentary cross sectional view of a prior art bladder with 3 dimensional internal stays.

FIG. 2 illustrates the internal construction of a prior art bladder 28 which could be used with the B.C. of FIG. 1. The bladder 28 is a single bag device which is formed from an inner liner 29 and an outer shell 30. The liner and the shell include inner layers 31 and 32 of polyurethane which are bonded to outer layers 33 and 34 of nylon fabric. The layers of polyurethane are bonded together around their peripheries to form an airtight bladder having an interior chamber 35.

The bladder 28 includes prior art 3 dimensional tubular stays 37. Each stay is generally rectangular in cross section and includes an inner layer 38 of nylon fabric and an outer layer 39 of polyurethane. The rectangular stay includes opposed walls 40 and 41 which are bonded to the polyurethane layers of the line 29 and the shell 30 and opposed walls 42 and 43 which extend between the liner and the shell.

FIG. 2 illustrates the bladder in an inflated condition. The portions 29*a* and 30*a* of the liner and shell which are bonded to the stays remain substantially straight, and the portions 29*b* and 30*b* between the stays expand outwardly. The overall configuration of the bladder remains substantially straight or rectilinear, and the bladder does not curve or conform to the body of the diver.

Figure 3:
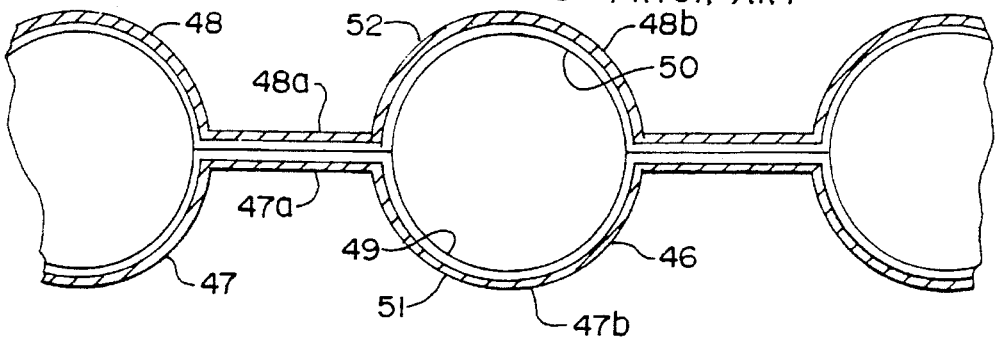
FIG. 3 PRIOR ART
FIG. 3 is a fragmentary cross sectional view of a prior art bladder with 2 dimensional stays.

FIG. 3 illustrates the internal construction of a prior art bladder 46 which includes an inner liner 47 and an outer shell 48. The liner and shell include layers of polyurethane 49 and 50 and layers of nylon fabric 51 and 52.

Portions 47*a* and 48*a* of the liner and shell are bonded together to form 2 dimensional stays, and portions 47*b* and 48*b* between the stays expand outwardly. However, the overall configuration of the bladder remains substantially straight or rectilinear.

Figure 4:
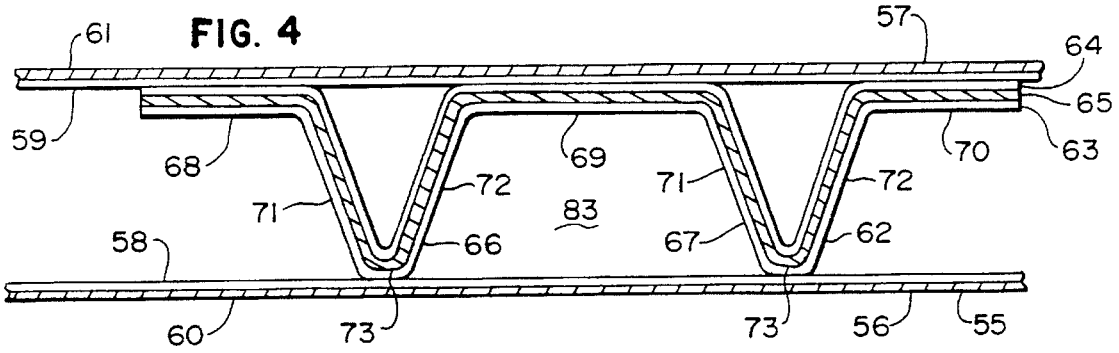
FIG. 4 is a fragmentary sectional view of a bladder which is formed in accordance with the invention.

FIG. 4 illustrates the internal construction of a non-inflated bladder 55 which is formed in accordance with the invention. The bladder 55 includes a liner 56 and a shell 57 which include layers of polyurethane 58 and 59 and layers of nylon fabric 60 and 61. An internal brace 62 connects the liner and shell. The brace includes outer layers 63 and 64 of polyurethane and inner layer 65 of nylon fabric.

The particular brace 62 illustrated in FIG. 4 includes a pair of generally V-shaped connection portions 66 and 67 and end panels 68, 69, and 70. Each of the V-shaped portions includes a pair of diverging connecting panels 71 and 72 which are joined at a bight portion 73. Each of the end panels 68 and 70 extends outwardly from one of the V-shaped portions, and the end panel 69 connects the V-shaped portions.

If desired, the liner, shell, and brace can be formed from materials other than polyurethane and nylon fabric. The thermoplastic layer can be replaced with any material which can be easily attached or bonded, for example, other thermoplastics. Thermoplastics are particularly suitable because they can be bonded by welding, heat fusion, radio frequency bonding, etc. The nylon fabric layer or equivalent provides a substrate for the bondable layer, facilitates the bonding operation, and ensures that bonding will occur only in the desired areas.

Figure 5:
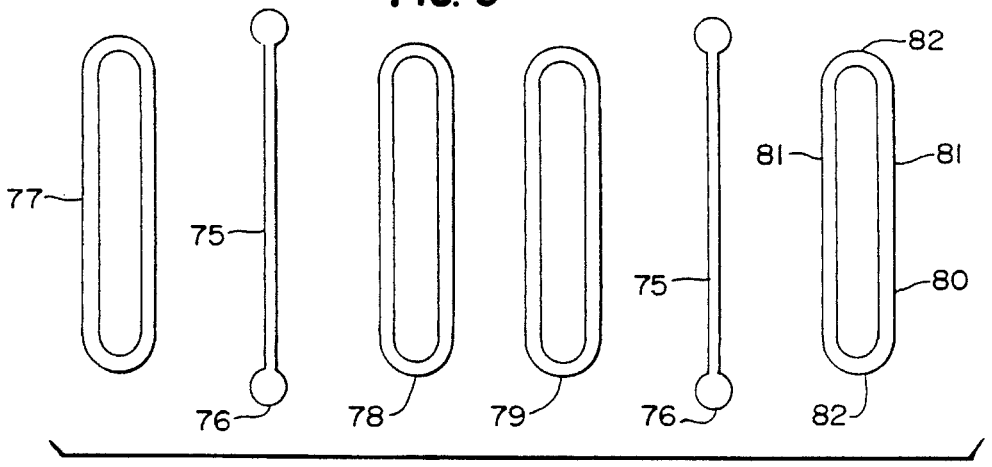
FIG. 5 illustrates the configuration of the weld which secure the internal brace of FIG. 4.

The brace is advantageously attached or bonded to the shell and liner of the bladder by a series of alternating weld joints. Referring to FIG. 5, the bight portions 73 of the V-shaped connecting portions 66 are attached to the liner 56 by liner bonds or welds 75. Each end of the liner welds terminates in a circular bonded area 76 which distributes stress which might arise if the weld terminated in a sharp end. The end panel 68 is bonded or welded to the shell 57 by an oval weld 77. The end panel 69 is bonded to the shell by a pair of oval welds 78 and 79, and the end panel 70 is bonded to the shell by an oval weld 80. Each of the oval welds includes a pair of parallel sides 81 and a pair of curved ends 82. The brace 62 therefore forms a pair of generally triangular bracing structures which are attached to the liner by a linear attachment and which are attached to the shell by a pair of spaced-apart planar attachments.

The internal braces extend longitudinally within the bladder, i.e., in the direction which is generally parallel to the diver when the diver is standing upright and wearing the bladder. The braces are particularly useful in the side lobes of a bladder for conforming the lobes to the torso of the diver. However, braces can be positioned in any location where it is desired to shape the bladder. Conventional stays can be used in other areas if desired. The peripheries of the bladder are bonded together to form an airtight chamber 83.

Figure 6:
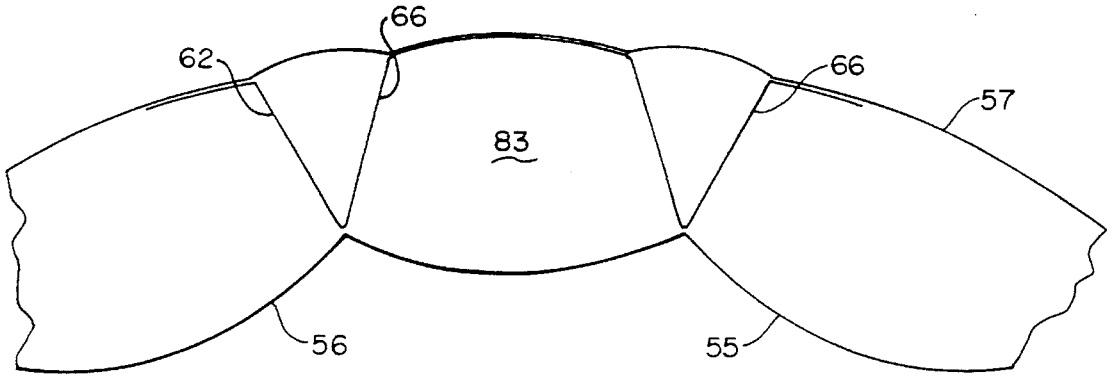
FIG. 6 is a fragmentary sectional view which illustrates the bladder of FIG. 4 in an inflated condition.

FIG. 6 illustrates the bladder in an inflated condition. As the bladder is pressurized to capacity, each of the V-shaped portions of the brace transfers the forces from the two oval welds on the shell 57 to the one linear weld on the liner 56. This concentration of force on the linear weld effectively shortens the liner by allowing a greater expansion or ballooning of the liner on either side of the linear welds as compared with the smaller expansion that occurs between the narrower spaced oval welds on the shell. This causes the bladder to bend inward at the linear weld. The second triangular portion creates the second bend, and its spacing relative to the first triangular portion determines the degree of conformity for the entire bladder lobe.

The number of and spacing of the welds can be changed to alter the bladder curvature. There are also other variations of weld configurations and fabric bracing panels that are possible. These variations remain within the scope and intent of this invention.

The invention controls the inflated form of the bladder through the construction of a series of internal braces that quite literally pull the walls of the bladder inward and towards its longitudinal center line, creating a curved form. The curving or wrapping of the side lobes allows the bladder to curving or wrapping of the side lobes allows the bladder to conform comfortably around the diver's torso, eliminating body squeeze and creating an ergonomic fit. Maintaining the bladder closer to the torso also allows for better control of positive buoyancy because of its stable proximal location of the center of mass of the diver. The longitudinal center line of the bladder corresponds generally to a vertical line through the center of mass of an upright diver.

Figure 7:
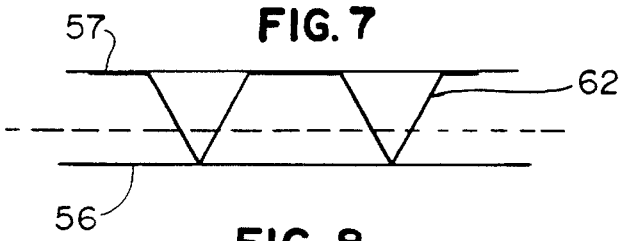
FIGS. 7–10 are views similar to FIG. 4 which illustrate other embodiments of the invention.
Figure 9:
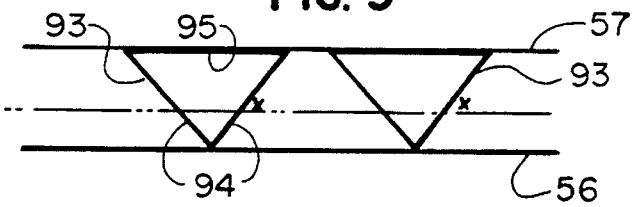
Figure 10:
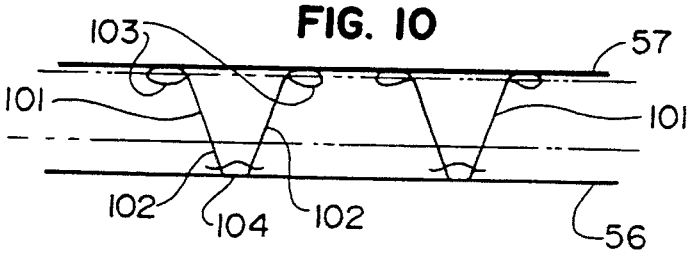
Figure 11:
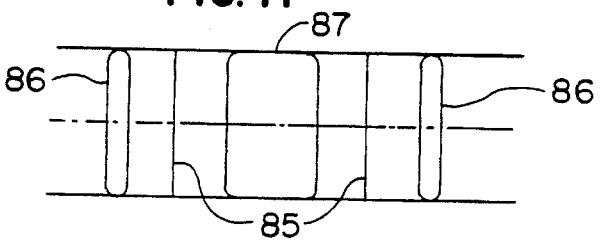
FIG. 11 is a view similar to FIG. 5 which illustrate configuration of welds for the embodiment of FIG. 7.

FIGS. 7–16 illustrate alternate embodiments of internal braces and weld configurations. FIG. 7 illustrates an internal brace 62 which has the same configuration as the brace illustrated in FIG. 4. However, the brace is attached to the liner and shell by different weld configurations. FIG. 11 illustrates a pair of linear welds 85 for attaching the V-shaped portions to the liner 56, a pair of oval welds 86 for attaching the end panels 68 and 70 to the shell 57, and a generally rectangular weld 87 for attaching the center panel 69 to the shell. Each of the linear welds preferably terminate in a rounded end portion as illustrated in FIG. 5.

Figure 8:
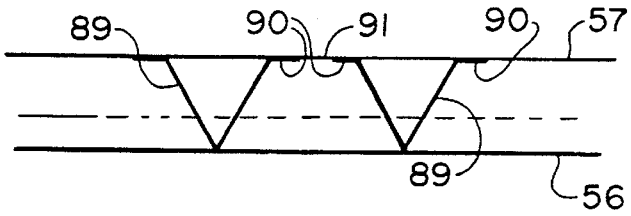

FIG. 8 illustrates a pair of separate V-shaped braces 89. Each brace includes a V-shaped bight portion which is secured to the liner 56 by a linear weld and a pair of end panels 90 which are secured to the shell 57 by an oval weld. The adjacent end panels of the braces are spaced apart at 91.

Figure 14:
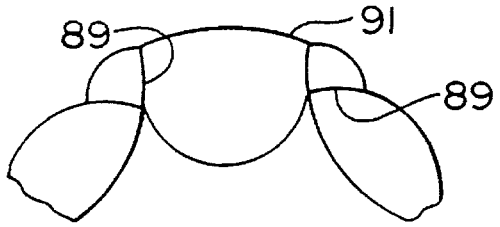
FIGS. 14–16 are views similar to FIG. 6 which illustrate the bladders of FIGS. 7, 9, and 10 respectively, in an inflated condition.

FIG. 14 illustrates the bladder of FIG. 8 in an inflated condition. The spacing 91 on the shell which is not connected to the braces is allowed to bulge outwardly.

Figure 12:
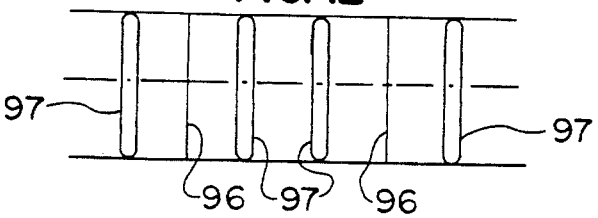
FIGS. 12 and 13 are views similar to FIG. 5 which illustrate configurations of welds for the embodiment of FIG. 9.
Figure 13:
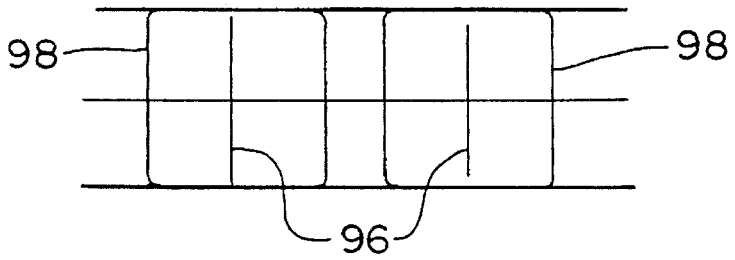

FIG. 9 illustrates a pair of separate triangular braces 93. Each brace includes a pair of diverging side panels 94 and a base panel 95 which connects the side panels. The bight portion of the side panels is connected to the liner 56 by a linear weld 96 (FIGS. 12 and 13). The base panel can be connected to the shell 57 by a pair of oval welds 97 (FIG. 12) or by a rectangular weld 98 (FIG. 13).

Figure 15:
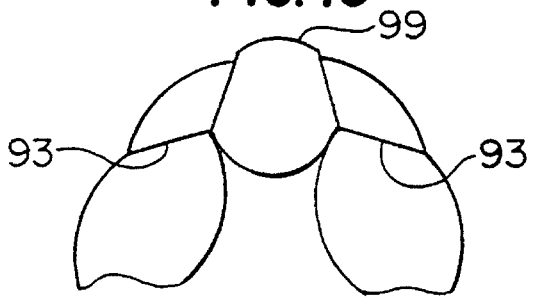

FIG. 15 illustrates the bladder of FIG. 9 in an inflated condition. The portion 99 of the shell between the two braces bulges outwardly.

FIG. 10 illustrates a pair of braces 101. Each brace includes a pair of diverging side panels 102 and a pair of end panels 103. However, rather than a V-shaped bight portion, the side panels are connected by a flat panel 104. Each of the walls can be connected to the liner or shell by an oval weld.

Figure 16:
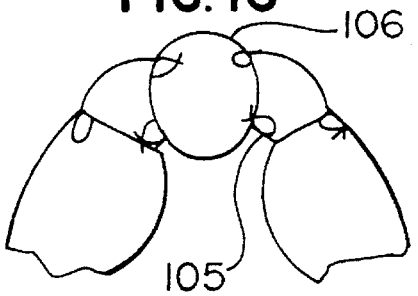

FIG. 16 illustrates the bladder of FIG. 10 in an inflated condition. The portions 105 of the shell 56 which are connected to the panels 104 remain relatively flat. The portions 106 of the shell between the braces bulges outwardly.

While in the foregoing specification a detailed description of specific embodiments of the invention were set forth for the purpose of illustration, it will be understood that many of the details herein given can be varied considerably by those skilled in the art without departing from the spirit and scope of the invention.

I claim:

1. An inflatable bladder comprising in liner and a shell, the liner and shell extending generally parallel and being secured together at peripheral portions thereof to form an internal chamber, and an internal brace within the chamber secured to the liner and the shell, the brace including first and second generally V-shaped connecting panels, each of the generally V-shaped connecting panels including a generally V-shaped bight portion secured to the liner by a generally linear weld and first and second end portions adjacent the shell, a first end panel extending between a first end portion of one of the generally V-shaped connecting panels and a second end portion of the other generally V-shaped connecting panel, the first end panel being connected to the shell at plurality of locations between said first and second end portions, and second and third end panels extending outwardly from the other end portions of the generally V-shaped connecting panels and connected to the shell at a plurality of locations.

2. The inflatable bladder of claim 1 in which each of the first, second, and third end panels is connected to the shell by a generally oval weld.

3. The inflatable bladder of claim 2 in which the first end panel is secured to the shell by a pair of generally oval welds.

4. An inflatable bladder comprising a liner and a shell, the liner and shell extending generally parallel and being secured together at peripheral portions thereof to form an internal chamber, and a pair of generally triangular braces within the chamber, each of the generally triangular braces including first and second connecting panels which diverge from the liner to the shell and an end panel which extends between the connecting panels, the first and second connecting panels of each of the triangular braces forming a generally V-shaped bight portion which is secured to the liner by a generally linear weld, the end panel of each of the triangular braces being secured to the shell at a plurality of locations between the first and second connecting panels.

5. The inflatable bladder of claim 4 in which the end panel of each of the triangular braces is connected to the shell by a generally oval weld.

6. An inflatable bladder comprising a liner and a shell, the liner and shell extending generally parallel and being secured together at peripheral portions thereof to form an internal chamber, and a pair of generally V-shaped internal braces between the liner and the shell, each of the generally V-shaped braces including a pair of connecting panels which diverge from the liner to the shell and which form a generally V-shaped bight portion which is connected to the liner by a linear weld and an end panel which extends laterally outwardly from each of the connecting panels adjacent the shell and which is connected to the shell at a plurality of locations laterally outwardly of the associated connecting panel.

7. The inflatable bladder of claim 6 in which each of the end panel is connected to the shell by generally oval weld.

* * * * *

UNITED STATES PATENT AND TRADEMARK OFFICE

CERTIFICATE OF CORRECTION

PATENT NO. : 5,599,219

DATED : February 4, 1997

INVENTOR(S) : Charles T. Green

It is certified that error appears in the above-indentified patent and that said Letters Patent is hereby corrected as shown below:

Col. 4, line 65 change "in" to —a—.

Col. 6, line 25 change "panel" to —panels— and insert —a— after "by".

Signed and Sealed this

Twenty-second Day of April, 1997

Bruce Lehman

*Attest:*

BRUCE LEHMAN

*Commissioner of Patents and Trademarks*

*Attesting Officer*